US011236568B2

(12) United States Patent
Tiwari et al.

(10) Patent No.: US 11,236,568 B2
(45) Date of Patent: Feb. 1, 2022

(54) POWERED ARTICULATED MAGNETIC FISHING TOOL

(71) Applicant: Saudi Arabian Oil Company, Dhahran (SA)

(72) Inventors: Shrikant Tiwari, Dhahran (SA); Opeyemi Adewuya, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/903,956

(22) Filed: Jun. 17, 2020

(65) Prior Publication Data

US 2021/0396087 A1 Dec. 23, 2021

(51) Int. Cl.

| | |
|---|---|
| ***E21B 31/06*** | (2006.01) |
| ***E21B 47/002*** | (2012.01) |
| ***E21B 31/14*** | (2006.01) |

(52) U.S. Cl.

CPC ..... *E21B 31/06* (2013.01); *E21B 31/14* (2013.01); *E21B 47/002* (2020.05)

(58) Field of Classification Search

CPC ..... E21B 31/06; E21B 31/14; E21B 47/09; E21B 47/002

See application file for complete search history.

(56) References Cited

U.S. PATENT DOCUMENTS

| | | | | |
|---|---|---|---|---|
| 2,333,802 A | | 11/1943 | Lowrey | |
| 2,459,614 A | | 1/1949 | Brown | |
| 2,595,632 A | | 5/1952 | Bivings et al. | |
| 2,726,881 A | * | 12/1955 | Howard | E21B 31/14 285/118 |
| 3,173,719 A | * | 3/1965 | Ringler | E21B 31/14 294/86.13 |
| 3,905,631 A | * | 9/1975 | Ricks | E21B 31/06 294/65.5 |
| 6,041,860 A | * | 3/2000 | Nazzal | E21B 29/00 166/250.01 |
| 7,357,183 B2 | | 4/2008 | Gazewood | |
| 9,587,442 B2 | * | 3/2017 | Thomas | E21B 23/14 |
| 10,677,039 B1 | * | 6/2020 | Avasarala | E21B 47/002 |
| 2003/0173084 A1 | * | 9/2003 | Fidan | G01V 11/002 166/301 |

(Continued)

FOREIGN PATENT DOCUMENTS

| | | |
|---|---|---|
| CN | 2120877 U | 11/1992 |
| CN | 2883666 Y | 3/2007 |

(Continued)

*Primary Examiner* — Shane Bomar

(74) *Attorney, Agent, or Firm* — Bracewell LLP; Constance G. Rhebergen; Brian H. Tompkins

(57) ABSTRACT

A powered articulated magnetic fishing tool having one or more knuckle or ball joints and a magnet to retrieve fish from a subterranean well and methods of retrieving the metallic object using the fishing tool. The fishing tool includes a magnet and one or more powered joints. The powered joints may each include or be coupled to a multi-axis position sensor that indicates the orientation of the joint and associated section downhole from the joint. The fishing tool may include a camera and a light located at the magnet end of the fishing tool. A system may include a human interface console located at the surface to control the fishing tool.

18 Claims, 5 Drawing Sheets

(56) References Cited

U.S. PATENT DOCUMENTS

| | | | | |
|---|---|---|---|---|
| 2012/0261114 | A1* | 10/2012 | Shoyhetman | E21B 31/06 166/99 |
| 2013/0014957 | A1* | 1/2013 | Hallundbæk | E21B 23/14 166/381 |
| 2015/0211316 | A1* | 7/2015 | Skjeie | E21B 34/14 166/99 |
| 2021/0285301 | A1* | 9/2021 | Maher | E21B 37/00 |

FOREIGN PATENT DOCUMENTS

| | | | |
|---|---|---|---|
| CN | 202609054 | U | 12/2012 |
| CN | 202990927 | U | 6/2013 |
| CN | 207538808 | U | 6/2018 |
| WO | 2004057149 | A1 | 7/2004 |

* cited by examiner

POWERED ARTICULATED MAGNETIC FISHING TOOL

BACKGROUND

Field of the Disclosure

The present disclosure generally relates to subterranean well developments. More specifically, embodiments of the disclosure relate to removing stuck or dropped objects (referred to as "fish") from a subterranean well.

Description of the Related Art

Drilling of wells, such as for oil and gas production or groundwater access, may require running various tools downhole in the well. A tool or a portion of tools may break and remain in the wellbore of a well, or a tool or a portion of a tool may not be retrieved and unintentionally left in the wellbore. Additionally, a part of a tool being used on the surface may fall into the well. These different objects inadvertently left or placed in the well may generally be referred to as "fish." Fish may become stuck or dropped in the wellbore and may be difficult to remove. Removal may be further complicated by the variety of unspecified sizes, shapes, or positions of fish.

SUMMARY

Fish stuck, left, or dropped in a well may result in delays and increased costs of drilling the well. For example, drilling operations may be paused until the fish is completely removed from the well. The longer the fish remains in the well, the greater the delays and cost of completing the drilling operations. Additionally, in some instances, the fish may obstruct access to sections of the wellbore that need to be accessed for other work.

Fishing tools are typically used to retrieve fish from a well. A variety of different fishing tools exist for different circumstances and may have different mechanisms, shapes, and sizes. A typical fishing tool grips the fish on the fish neck or profile and applies upward force to retrieve the fish from the well. However, existing fishing tools may be less effective and unable to engage larger fish or fish lodged at an angle, as such tools may not have a sufficient contact area to grab the fish. The use of an ineffective fishing tool may further increase the delays and cost caused by the fish, as drilling operations may remain suspended and additional fishing operations may be required to remove the fish.

In one embodiment, a tool for retrieving a metallic object in a well is provided. The tool includes a first section, and a second section having a first end and a second end, such that the first end is coupled to the first section and the second end includes a magnet. The tool further includes a joint coupling the first end of the first section to the second section, such that the joint is a knuckle joint or a ball joint and the joint is moveable via power received from a power source. The joint is operable to move the second section between a first position and a second position, such that the second end having the magnet is moveable to engage the metallic object.

In some embodiments, the tool includes camera coupled to the second section and oriented to view the second end having the magnet, such that the camera is operable to transmit digital video data to the surface. In some embodiments, the tool includes a light coupled to the second section and oriented to illuminate the second end. In some embodiments, the first section is configured to be coupled to a pipe string. In some embodiments, the joint is a first joint, such that the tool includes a third section having a first end and a second end, a second joint coupling the second end of the third section to the first section, such that the second joint is a knuckle joint or a ball joint, the second joint is moveable via power received from the power source, and the second joint is operable to move the first section between a third position and a fourth position. In some embodiments, the power source is an electrical power source at the surface. In some embodiments, the joint is connected to the electrical power source via an electrical connector. In some embodiments, the power source is a hydraulic power source at the surface. In some embodiments, the joint is connected to the hydraulic power source via a hydraulic line. In some embodiments, the joint includes a position sensor configured to indicate a position of the joint.

In another embodiment, a system for retrieving a metallic object in a well extending from a surface is provided. The system includes a tool for retrieving a metallic object in a well is provided. The tool includes a first section, and a second section having a first end and a second end, such that the first end is coupled to the first section and the second end includes a magnet. The tool further includes a joint coupling the first end of the first section to the second section, such that the joint is a knuckle joint or a ball joint and the joint is moveable via power received from a power source. The joint is operable to move the second section between a first position and a second position, such that the second end having the magnet is moveable to engage the metallic object. The system further includes a human interface console, the human interface console having a processor and a non-transitory computer-readable memory. The human interface console further includes a control operable to control movement of the joint between the first position and the second position.

In some embodiments, the human interface console includes a display. In some embodiments, the joint includes a position sensor. In some embodiments, the non-transitory computer-readable memory includes instructions that, when executed by the processor, perform the operations of receiving a signal from the position sensor, the signal indicative of a position of the joint and displaying a position indicator on the display to indicate the position of the joint. In some embodiments, the tool includes a camera coupled to the second section and oriented to view the second end having the magnet, such that the camera is operable to transmit digital video data to the surface. In some embodiments the non-transitory computer-readable memory includes instructions that, when executed by the processor, perform the operations of receiving digital video data from the camera and displaying video on the display. In some embodiments, the control is a hardware control. In some embodiments, the human interface console includes a power control operable to control power to the tool.

In another embodiment, a method for retrieving a metallic object in a well extending from a surface is provided. The method includes inserting a tool into a wellbore of the well. The tool includes a first section, and a second section having a first end and a second end, such that the first end is coupled to the first section and the second end includes a magnet. The tool further includes a joint coupling the first end of the first section to the second section, such that the joint is a knuckle joint or a ball joint and the joint is moveable via power received from a power source. The joint is operable to move the second section between a first position and a second position. The method further includes moving the joint between a first position and a second position, such that the magnet engages the metallic object and removing the tool and the metallic object from the wellbore.

In some embodiments, the power source is an electrical power source at the surface or a hydraulic power source at the surface. In some embodiments, the joint includes a position sensor configured to indicate a position of the joint. In some embodiments, moving the joint includes operating a control of a human interface console located at the surface.

DETAILED DESCRIPTION

The present disclosure will be described more fully with reference to the accompanying drawings, which illustrate embodiments of the disclosure. This disclosure may, however, be embodied in many different forms and should not be construed as limited to the illustrated embodiments. Rather, these embodiments are provided so that this disclosure will be thorough and complete, and will fully convey the scope of the disclosure to those skilled in the art.

Embodiments of the disclosure include a powered articulated magnetic fishing tool having one or more knuckle or ball joints and a magnet to retrieve fish from a subterranean well. As used herein the term "fish" refers to objects (such as broken tools or parts of tools) left in a well or that have fallen into a well from the surface. The fishing tool described in the disclosure enables the retrieval of fish disposed in a wellbore at an angle or acutely oriented from a preferred position for retrieval.

The fishing tool includes a magnet and one or more powered joints. The powered joints may include a knuckle joint, a ball joint, or any combination thereof. The powered joint may be electrically powered or a hydraulically powered and may include a motor, a servomechanism, a hydraulic articulator, or other mechanism powered by electrical or hydraulic connections. In some embodiments, the powered joints may each include or be coupled to a multi-axis position sensor that indicates the orientation of the joint and associated section downhole from the joint.

The fishing tool may include a camera and a light located at the magnet end of the fishing tool. The camera and light may be located at a sufficient distance from the magnet end to provide a view of the magnet end and location and orientation of the fish for retrieval.

The fishing tool may be controlled by a human interface console located at the surface. The fishing tool may receive signals from and transmit signals to the human interface console. For example, the fishing tool may receive power (for example, electrical or hydraulic power) from the surface. The fishing tool may transmit data (for example, sensor data from the multi-axis position sensor, digital video data from the camera) to the surface to be received and viewed at the human interface console. The human interface console may also include various hardware or software controls for operation of the fishing tool. Such controls may include a power control, a light control, and control of each joint of the fishing tool. The console may display a directional indicator for each joint and associated section and video received from the camera.

Figure 1:
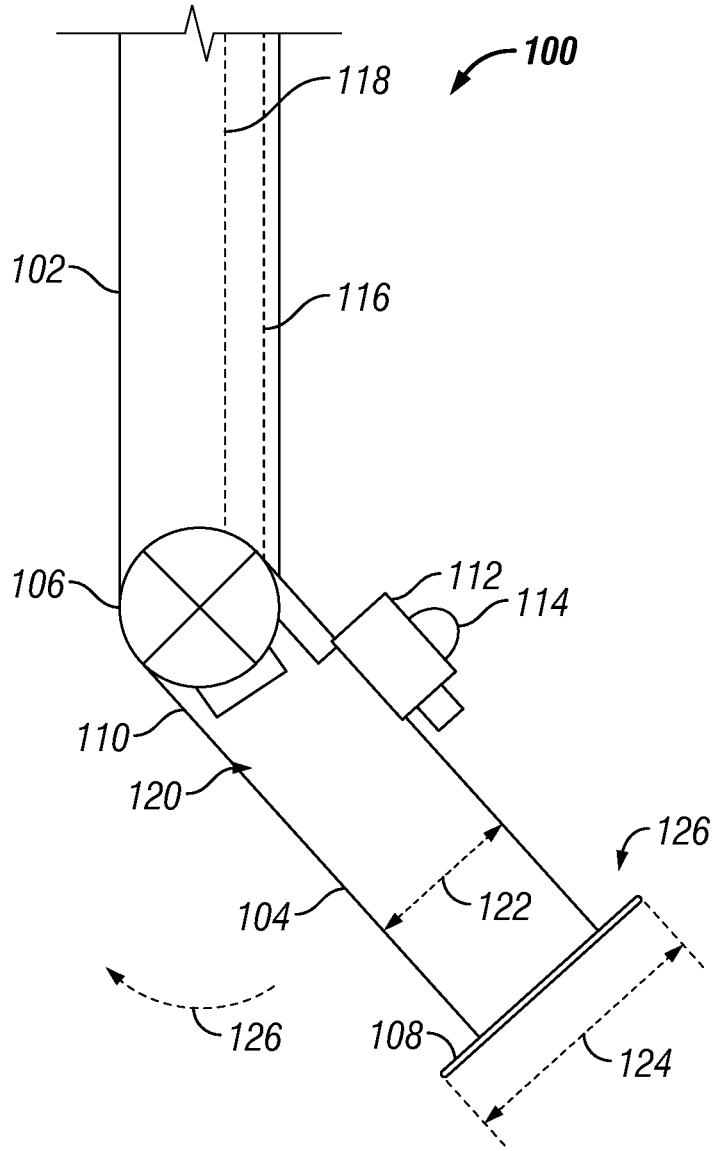
FIG. 1 is a schematic diagram of a powered articulated magnetic fishing tool in accordance with an embodiment of the disclosure.
Figure 2:
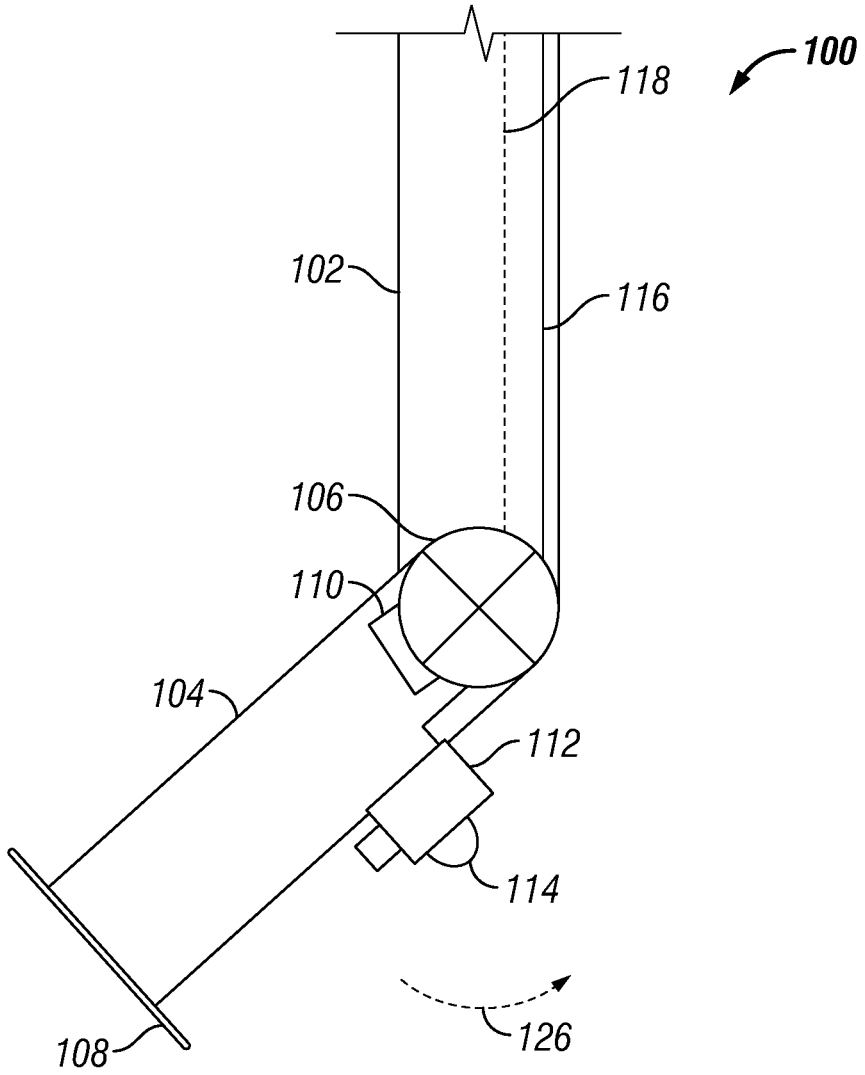
FIG. 2 is another schematic diagram of the powered articulated magnetic fishing tool of FIG. 1.

FIGS. 1 and 2 are schematic diagrams of a powered articulated magnetic fishing tool 100 in accordance with an embodiment of the disclosure. As shown in these figures, the fishing tool 100 may include a first section 102 and a second section 104 coupled by a powered joint 106. The fishing tool 100 may also include a magnet 108, multi-axis position sensor 110, a camera 112, and a light 114. The fishing tool 100 may include an electrical conduit 116 and, in some embodiments, a hydraulic line 118.

The sections 102 and 104 of the fishing tool 100 may be pipes or other tubular structures having an outer diameter, thickness, and an inner diameter. For example, the sections 102 and 104 may define a hollow interior 120 having a thickness defined by an inner diameter 122 and an outer diameter (not shown). In some embodiments, the sections 102 and 104 may have the same diameters and thicknesses. In other embodiments, the sections 102 and 104 may have different diameters and thicknesses. In some embodiments, the sections 102 and 104 may be formed from a metal alloy (for example, a steel alloy or aluminum alloy). In other embodiments, the sections 102 and 104 may be formed from other materials. The sections 102 and 104 are coupled via the powered joint 106. The sections 102 and 104 may each be coupled to the powered joint 106 via suitable techniques or components based on the materials and type of joint. For example, in some embodiments, the sections 102 and 104 may be each be coupled to the powered joint 106 via welding, fasteners (for example rivets), adhesive (for example, metal bonding), or any combination thereof.

The powered joint 106 may be a knuckle joint or a ball joint. In some embodiments, the powered joint 106 is electrically powered. In such embodiments, the powered joint may include or be coupled to a motor. In some embodiments, the powered joint 106 may include or be coupled to an electric servomechanism. The powered joint 106 may receive power via the electrical conduit 116. In other embodiments, the powered joint 106 is hydraulically powered. In such embodiments, the power joint may include or be coupled to a hydraulic actuator or a hydraulic servomechanism. In such embodiments, the fishing tool 100 may include the hydraulic line 118, such that the powered joint 106 is moved via hydraulic pressure fluidly communicated via the hydraulic line 118. It should be appreciate that in embodiments in which the powered joint 106 is electrically powered, the fishing tool 100 may not include the hydraulic line 118. In these embodiments, the powered joint 106 may be moved by a signal sent from a human interface console to the movement mechanism, the power source powering the joint, or both.

The fishing tool 100 includes the magnet 108 having a width 124 for magnetically coupling to fish in a well. The magnet 108 may be coupled to an end 126 of the section 104. For example, the magnet 108 may be coupled to the end 126 via welding, fasteners (for example, rivets), adhesive (for example, metal bonding), or any combination thereof. The magnet 108 may be a variety of different shapes or surfaces. In some embodiments, the shape or surface may be selected based on the size and shape of the well or the size and shape of a fish. In some embodiments, the magnet 108 may be generally planar. In some embodiments, the width 124 of the magnet 108 may be greater than the outer diameter of the section 104. In other embodiments, the width 124 of the magnet 108 may be equal to or less than the outer diameter of the section 104.

In some embodiments, the multi-axis position sensor 110 may measure displacement on two or more axes. In some embodiments, the multi-axis position sensor 110 may measure linear or angular displacement. For example, in some embodiments the multi-axis position sensor 110 may measure displacement on two axes of a plane. In some embodiments, the multi-axis position sensor 110 may be a rotary or linear variable differential transformer (LVDT) a rotary encoder, and optical position sensor, or other suitable sensors. The multi-axis position sensor 110 may transmit a signal to the surface indicative of the measurement by the sensor 110.

The video camera 112 may be coupled to the outer surface of the section 104 and oriented in a generally downhole direction to capture the area around the magnet 108 of the fishing tool 100. The light 114 may be located on the camera 112 and be oriented to illuminate the area around the magnet 108 of the fishing tool 100. In some embodiments, the light 114 may be integrated in the camera 112. The video camera 112 may transmit a digital data corresponding to recorded video to the surface. As will be appreciated, the video camera 112 may provide real-time feedback to an operator at the surface, enabling the operator to move the fishing tool 100 to an optimal position for engagement with a fish. In some embodiments, the video camera 112 may include a non-volatile memory and may store recorded video.

FIGS. 1 and 2 also illustrate articulation of the second section 104 of the fishing tool 100. As discussed in the disclosure, the powered joint 106 may enable articulation of the section 104 relative to the first section 102. In some embodiments, the powered joint 106 is knuckle joint that provides for movement in a plane and relative to the center axis of the fishing tool 100, as shown by arrows 126 in FIGS. 1 and 2. In other embodiments, the powered joint 106 is a ball joint that provides for movement in 360 degrees from the center axis of the fishing tool 100. In some embodiments, the ball joint may also provide 360 degree rotational movement around the center axis of the fishing tool. It should be appreciated that the powered joint 106 may provide for movement between a number of discrete or continuous positions (for example, distances from a center axis or center point) within a range of movement provided by the powered joint 106.

The fishing tool 100 may be coupled to a pipe string (for example, a fishing string or drill pipe) for insertion into a wellbore a well. The fishing tool 100 may be coupled to the pipe string via a threaded coupling, a welded coupling, or other type of coupling known in the art. For example, in some embodiments the first section 102 of the fishing tool 100 may include a threaded end configured to engage with threads of a pipe string. The pipe string may of sufficient length to ensure the fishing tool 100 reaches the depth at which a fish is located so that the magnet 108 may engage the fish.

Figure 3:
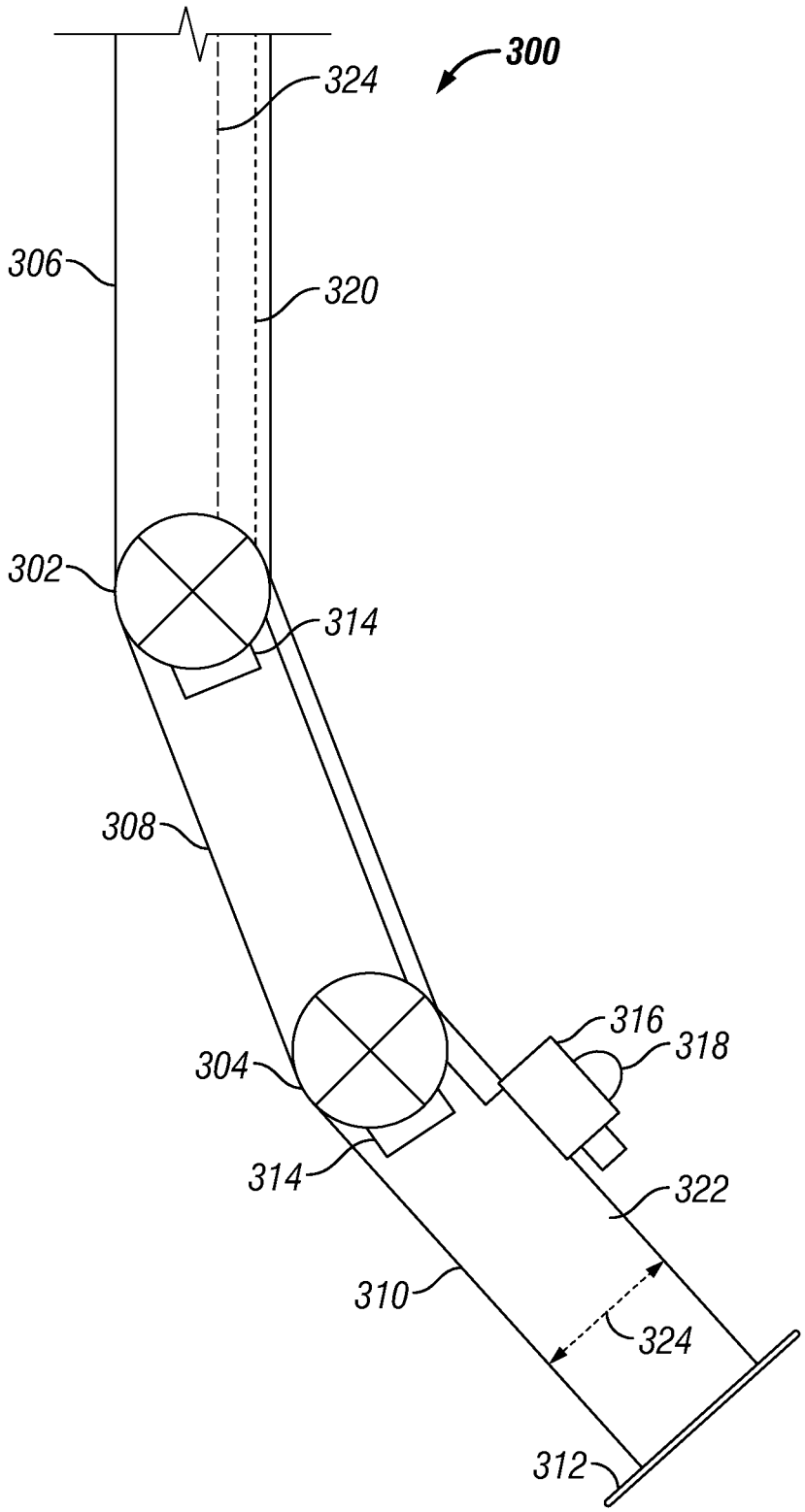
FIG. 3 is a schematic diagram of a powered articulated magnetic fishing tool having two powered joints in accordance with an embodiment of the disclosure.

In some embodiments, a fishing tool according to the disclosure may have multiple powered joints and corresponding sections. For example, in some embodiments a fishing tool may have two, three, four, or more powered joints. FIG. 3 is a schematic diagram of a powered articulated magnetic fishing tool 300 having two powered joints 302 and 304 in accordance with an embodiment of the disclosure. As shown in FIG. 3, the fishing tool 300 may include a first section 306, a second section 308, and a third section 310. The first section 306 is coupled to the second section 308 via the powered joint 302, and the second section 308 is coupled to the third section 310 by the powered joint 304. The sections 306, 308, and 310 may each be coupled to the appropriate powered joint 302 or 304 via suitable techniques or components based on the materials and type of joint. For example, in some embodiments, the sections 306, 308, and 310 may be each be coupled to the appropriate powered joint 302 or 304 via welding, fasteners (For example rivets), adhesive (for example, metal bonding), or any combination thereof.

The fishing tool 300 may also include a magnet 312, multi-axis position sensors 314, a camera 316, and a light 318 that are similar to and have the same functions as the components described supra with respect to the fishing tool 300. The fishing tool 300 may also include an electrical conduit 320 and, in some embodiments, a hydraulic line (not shown).

The sections 306, 308, and 310 of the fishing tool 300 may each be a pipe or other tubular structure having an outer diameter, thickness, and an inner diameter. For example, the sections 306, 308, and 310 may each define a hollow interior 322 having a thickness defined by an inner diameter 324 and an outer diameter (not shown). In some embodiments, the sections 306, 308, and 310 may each have the same diameters and thicknesses. In other embodiments, the sections 306, 308, and 310 may each have different diameters and thicknesses. In some embodiments, the sections 306, 308, and 310 may be formed from a metal alloy (for example, a steel alloy or aluminum alloy). In other embodiments, the sections 306, 308, and 310 may be formed from other materials.

The powered joint 302 may be a knuckle joint or a ball joint, and the powered joint 304 may be a knuckle joint or a ball joint. The powered joints 302 and 304 may be the same type of joint or different joints. For example, the powered joints 302 and 304 may be knuckle joints. In other embodiments, the powered joints 302 and 304 may be ball joints. In some embodiments, the powered joint 302 may be a knuckle joint and the powered joint 304 may be a ball joint, or the powered joint 302 may be a ball joint and the powered joint 304 may be a knuckle joint. Thus, in embodiments having multiple powered joints, any combination of knuckle joints and ball joints may be used.

In some embodiments, the joints 302 and 304 are electrically powered. In such embodiments, the powered joints 302 and 304 may each include or be coupled to a motor. In some embodiments, the powered joints 302 and 304 may include or be coupled to an electric servomechanism. The powered joints 302 and 304 may receive power via the electrical conduit 320. In other embodiments, the powered joints 302 and 304 may be hydraulically powered. In such embodiments, the powered joints 302 and 304 may each include or be coupled to a hydraulic actuator or a hydraulic servomechanism. In such embodiments, the fishing tool 300 may include the hydraulic line (not shown), such that powered joints 302 and 304 are moved via hydraulic pressure fluidly communicated via the hydraulic line. It should be appreciated that in embodiments in which the powered joints 302 and 304 are electrically powered, the fishing tool 300 may not include the hydraulic line.

FIG. 3 depicts an example of how the articulated magnetic fishing tool 300 having two powered joints may be articulated relative to the center line 324 of the first section of the tool 300. The second section 308 and third section 310 may be moved independently of each other. As shown in FIG. 3, the second section 308 may be moved to a first position relative to the center line 324 by the powered joint 302. The third section 310 may be moved to a second position relative to the center line 324 by the powered joint 304, such that the first position and second position define different angles with respect to the center line 324. Although FIG. 3 shows the third section 310 moved in the same direction as the second section 308, in other embodiments the third section 310 may be moved a different direction (for example, an opposite direction) than the second section 308. The independent movement of each of the sections 308 and 310 may enable the fishing tool 300 to further manipulate the magnet 312 to a suitable orientation for engaging a metallic object stuck or dropped in a well. It should be appreciated that the powered joints 302 and 304 may each provide for movement between a number of discrete or continuous positions (for example, distances from a center axis or center point) within a range of movement provided by the powered joints 302 and 304.

Figure 4:
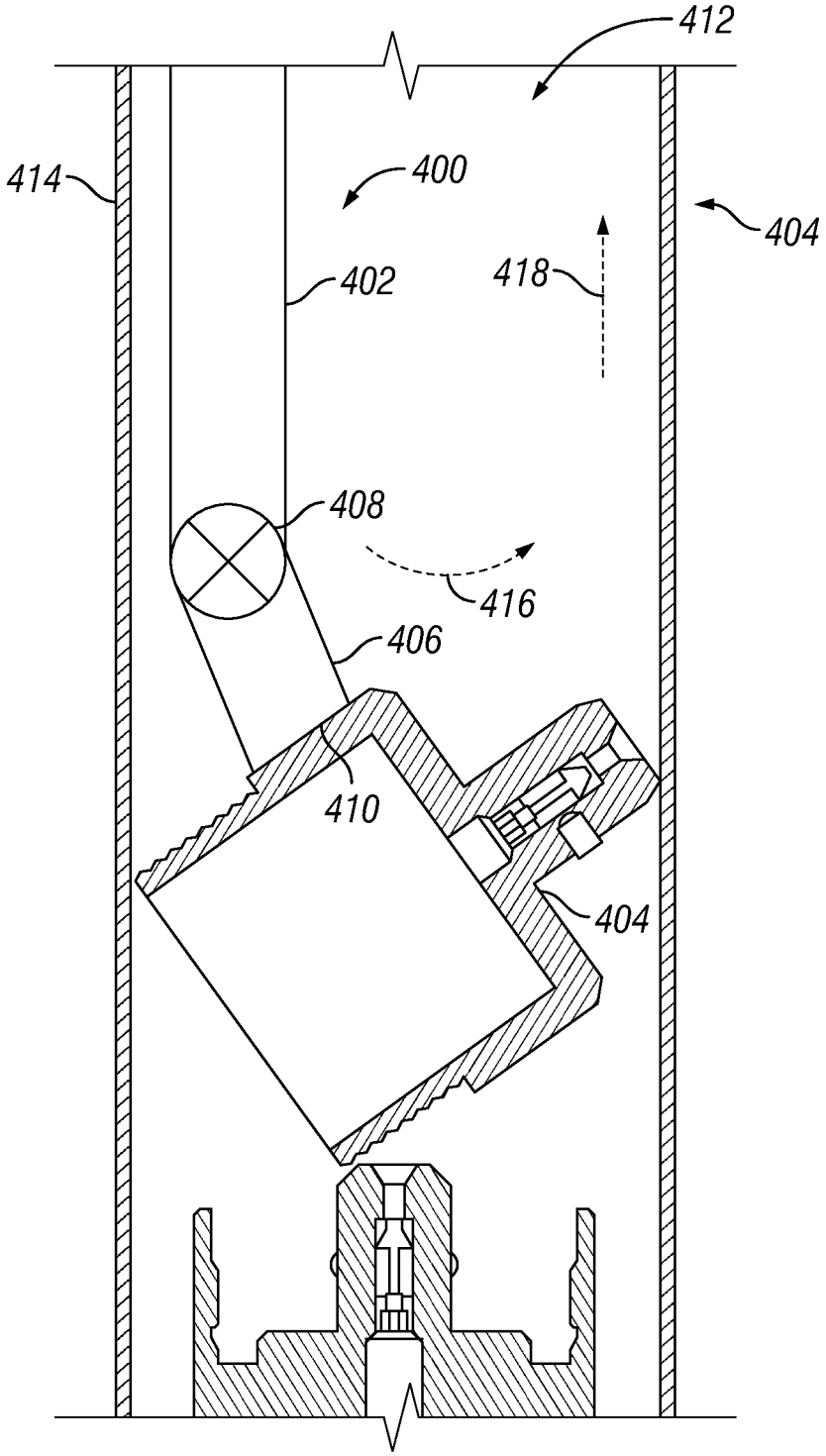
FIG. 4 is a schematic diagram of illustrating operation of an articulated magnetic fishing tool to retrieve a metallic object in accordance with an embodiment of the disclosure.

FIG. 4 is a schematic diagram illustrating operation of an articulated magnetic fishing tool 400 to retrieve a metallic object 402 (that is, a "fish") in accordance with an embodiment of the disclosure. As shown in FIG. 4, the fishing tool 400 may include a first section 404 and a second section 406 coupled by a powered joint 408. The fishing tool 400 may also include a magnet 410. Other components of the fishing tool 400, such as a multi-axis position sensor, a camera, a light, and conducts or lines, are omitted from the figure for clarity.

FIG. 4 depicts the metallic object 402 located in a wellbore 412 of a well 414. In certain embodiments, the metallic object 402 may be preventing access to other portions of the well 414. As shown in FIG. 4, the metallic object 402 is positioned at an acute angle relative to the wellbore 412. As discussed in the disclosure, this orientation of the metallic object 402 may make the fish difficult to retrieve using conventional fishing tools.

The fishing tool 400 may be inserted into the wellbore 412 of the well 414 to contact and retrieve the metallic object 402. After insertion into the wellbore 412, an operator may use a video camera and light (not shown) of the fishing tool 400 to observe the metallic object 402 in real-time and determine the orientation of the metallic object 402. The powered joint 408 may be operated and the resulting changes to the orientation of the magnet 410 observed in real-time.

The powered joint 408 may enable orientation of the magnet 410 of the fishing tool 400 into an optimal position that maximizes contact between the magnet 410 and the metallic object 402. For example, as shown in FIG. 4, the second section 406 may be moved in the direction indicated by arrow 416 to position the magnet 410. The magnet 410 may contact the metallic object 402 at an angle that maximizes the contact between the surface area of the magnet 410 and the metallic object 402. After securing contact between the magnet 410 and the metallic object 402, the fishing tool 400 and metallic object 402 may be removed from the wellbore 412 in the direction indicated by arrow 418. After removal, drilling or other operations on the well 414 may resume.

Figure 5:
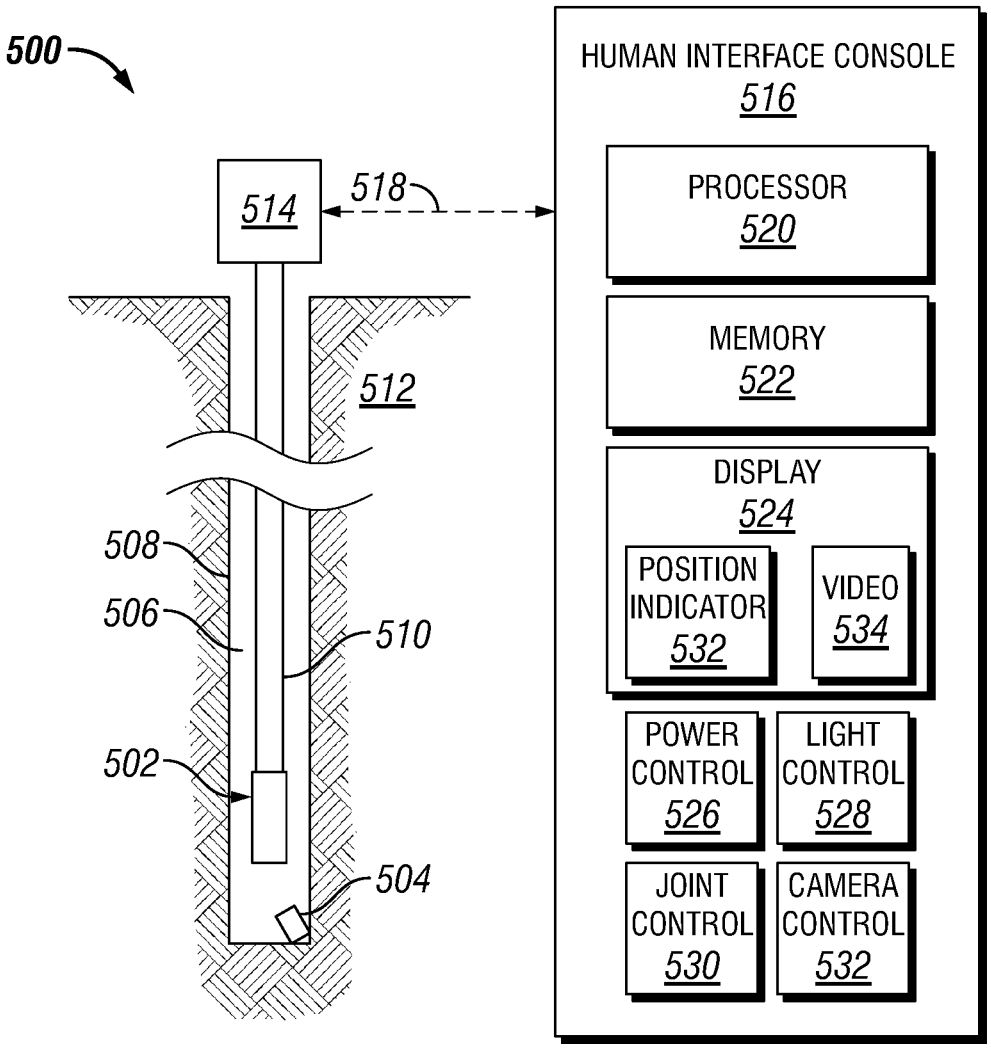
FIG. 5 is a schematic diagram of a system with an articulated magnetic fishing tool in accordance with an embodiment of the disclosure.

FIG. 5 depicts a system 500 with an articulated magnetic fishing tool 502 used to retrieve a fish 504 stuck in a wellbore 506 of a well 508 extending into a formation 512 in accordance with an embodiment of the disclosure. The fishing tool 502 may be coupled to a pipe string 510 inserted into the wellbore 506. The pipe string 510 may be coupled to and controlled at the surface via a surface equipment 514 (such as a kelly system, top drive, or other equipment). The fishing tool 502 may be in communication with a human interface console 516 for observing and controlling the tool 502. For example, the fishing tool 502 may be wired or wirelessly connected to the human interface console, such as via a wired electrical connector 518 shown in FIG. 5. In such embodiments, the electrical connector 518 may carry signals to and from components of the fishing tool 502. For example, the electrical connector 518 may carry signals from position indicators and a video camera of the fishing tool 502. The electrical connection 518 may also carry control signals from the human interface console 516 to components of the fishing tool 502, such as to powered joints, the light, and a video camera. In some embodiments, the human interface console 516 may include an electrical power source (not shown) for powering the fishing tool 502. In some embodiments, the fishing tool 502 may be coupled to a separate source of electrical or hydraulic power.

The human interface console 516 includes various components to enable observation and control of the fishing tool 502. In some embodiments, the human interface console 516 includes a processor 520, a memory 522, and a display 524. The human interface console 516 may further include a power control 526, a light control 528, a joint control 530, and a camera control 532.

Each of the controls 526, 528, 530, and 532 may be a hardware control (for example, a switch or a button) or a software control (for example, a virtual switch or virtual button of a graphical user interface displayed on the display 524). The power control 526 may activate power to the fishing tool 502. For example, the power control 526 may activate or deactivate electrical power or hydraulic power to the fishing tool 502, such by initiating the sending of a signal to a source of electrical or hydraulic power. In some embodiments, the power control 526 may activate or deactivate power to all components of the fishing tool 502, such as the powered joints, camera, and light.

The light control 528 may activate or deactivate a light source of the fishing tool 502, such as by initiating the sending of a signal to the light source. The joint control 530 may include one or more joint controls for activating and operating the joints of the fishing tool 502. The joint control 530 may enable movement of a knuckle joint or ball joint of a fishing tool in the range and direction of movement provided by the joint. In some embodiments, for example, the joint control 530 may include a rotatable dial for moving a joint of the fishing tool 502. The camera control 532 may activate or deactivate a camera of the fishing tool 502.

The human interface console 516 may display various indicators and visuals relating to operation of the fishing tool 502 on the display 524. For example, the display 524 may display a position indicator 536 corresponding to each joint of the fishing tool 502. The position indicator 536 may indicate a position of a joint of the fishing tool, such after operation of the joint via the joint control 530. For example, the position indicator 536 may indicate a position in degrees (such as degrees from a center axis) or distance (such as distance from a center axis).

The display 524 may also display video 534 received as digital data from a video camera of the fishing tool 502. In some embodiments, the display of the video 534 may be automatically activated when the video camera is activated by the camera control 532.

A process for using the embodiments of the fishing tool may include inserting the fishing tool into a wellbore of a well and moving a joint of the tool between a first position and a second position that a magnet of the tool magnetically engages the metallic object. For example, as discussed in the disclosure, the joint may be a knuckle joint or ball joint, and moving the tool may include operating a control on a human interface console at the surface. The tool and the magnetic object may then be removed from the wellbore.

Ranges may be expressed in the disclosure as from about one particular value, to about another particular value, or both. When such a range is expressed, it is to be understood that another embodiment is from the one particular value, to the other particular value, or both, along with all combinations within said range.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments described in the disclosure. It is to be understood that the forms shown and described in the disclosure are to be taken as examples of embodiments. Elements and materials may be substituted for those illustrated and described in the disclosure, parts and processes may be reversed or omitted, and certain features may be utilized independently, all as would be apparent to one skilled in the art after having the benefit of this description. Changes may be made in the elements described in the disclosure without departing from the spirit and scope of the disclosure as described in the following claims. Headings used in the disclosure are for organizational purposes only and are not meant to be used to limit the scope of the description.

What is claimed is:

1. A tool for retrieving a metallic object in a well extending from a surface, comprising:
- a first section;
- a second section comprising a first end and a second end, the first end coupled to the first section and the second end comprising a magnet;
- a first joint coupling the first end of the second section to the first section, wherein the first joint comprises a knuckle joint or a ball joint, the first joint moveable via power received from a power source;
- wherein the first joint is operable to move the second section between a first position and a second position, such that the second end comprising the magnet is moveable to engage the metallic object;
- a third section having a first end and a second end; and
- a second joint coupling the second end of the third section to the first section, wherein the second joint comprises a knuckle joint or a ball joint, the second joint moveable via power received from the power source,
- wherein the second joint is operable to move the first section between a third position and a fourth position.

2. The tool of claim 1, comprising:
- a camera coupled to the second section and oriented to view the second end comprising the magnet, wherein the camera is operable to transmit digital video data to the surface.

3. The tool of claim 2, comprising a light coupled to the second section and oriented to illuminate the second end.

4. The tool of claim 1, wherein the first section is configured to be coupled to a pipe string.

5. The tool of claim 1, wherein the power source comprises an electrical power source at the surface.

6. The tool of claim 5, wherein the first joint is connected to the electrical power source via an electrical connector.

7. The tool of claim 1, wherein the power source comprises a hydraulic power source at the surface.

8. The tool of claim 7, wherein the first joint is connected to the hydraulic power source via a hydraulic line.

9. The tool of claim 1, wherein the first joint comprises a position sensor configured to indicate a position of the joint.

10. A system for retrieving a metallic object in a well extending from a surface; comprising:
- a tool comprising:
  - a first section;
  - a second section comprising a first end and a second end, the first end coupled to the first section and the second end comprising a magnet;
  - a joint coupling the first end of the second section to the first section, wherein the joint comprises a knuckle joint or a ball joint, the joint moveable via power received from a power source;
  - wherein the joint is operable to move the second section between a first position and a second position, such that the second end comprising the magnet is moveable to engage the metallic object, wherein the joint comprises a position sensor;
- a human interface console, the human interface console comprising:
  - a processor;
  - a non-transitory computer-readable memory; and
  - a control operable to control movement of the joint between the first position and the second position; and
  - a display, wherein the non-transitory computer-readable memory comprises instructions that, when executed by the processor, perform the operations of:
    - receiving a signal from the position sensor, the signal indicative of a position of the joint; and
    - displaying a position indicator on the display to indicate the position of the joint.

11. The system of claim 10, wherein the tool comprises a camera coupled to the second section and oriented to view the second end comprising the magnet, wherein the camera is operable to transmit digital video data to the surface.

12. The system of claim 11, wherein the non-transitory computer-readable memory comprises instructions that, when executed by the processor, perform the operations of:
- receiving digital video data from the camera; and
- displaying video on the display.

13. The system of claim 10, wherein the control comprises a hardware control.

14. The system of claim 10, wherein the human interface console comprises a power control operable to control power to the tool.

15. A method for retrieving a metallic object in a well extending from a surface, the method comprising:
- inserting a tool into a wellbore of the well, wherein the tool comprises:
  - a first section;
  - a second section comprising a first end and a second end, the first end coupled to the first section and the second end comprising a magnet;
  - a first joint coupling the first end of the second section to the first section, wherein the first joint comprises a knuckle joint or a ball joint, the first joint moveable via power received from a power source;
  - wherein the first joint is operable to move the second section between a first position and a second position;

a third section having a first end and a second end; and a second joint coupling the second end of the third section to the first section, wherein the second joint comprises a knuckle joint or a ball joint, the second joint moveable via power received from the power source, wherein the second joint is operable to move the first section between a third position and a fourth position moving the first joint between a first position and a second position, such that the magnet engages the metallic object;

removing the tool and the metallic object from the wellbore.

16. The method of claim 15, wherein the power source comprises an electrical power source at the surface or a hydraulic power source at the surface.

17. The method of claim 15, wherein the first joint comprises a position sensor configured to indicate a position of the first joint.

18. The method of claim 15, wherein moving the first joint comprises operating a control of a human interface console located at the surface.

* * * * *